US012004599B1

(12) United States Patent
Mount

(10) Patent No.: US 12,004,599 B1
(45) Date of Patent: Jun. 11, 2024

(54) MAGNETIC SHOELACES AND METHOD OF USE

(71) Applicant: Penguin Magic, Inc., Rancho Cordova, CA (US)

(72) Inventor: Donnovan Lane Mount, Mansfield, OH (US)

(73) Assignee: Penguin Magic, Inc., Rancho Cordova, CA (US)

( * ) Notice: Subject to any disclaimer, the term of this patent is extended or adjusted under 35 U.S.C. 154(b) by 0 days.

(21) Appl. No.: 18/312,957

(22) Filed: May 5, 2023

(51) Int. Cl.
*A43C 11/00* (2006.01)
*A63J 21/00* (2006.01)

(52) U.S. Cl.
CPC ..... *A43C 11/00* (2013.01); *A63J 21/00* (2013.01); *A44D 2203/00* (2013.01)

(58) Field of Classification Search
CPC ..... A63C 9/04; A63C 9/06; A63J 1/00
USPC ..... 472/71, 72
See application file for complete search history.

(56) References Cited

U.S. PATENT DOCUMENTS

2008/0295305 A1* 12/2008 Hsu ..... A43C 9/04 24/715.6
2014/0215770 A1* 8/2014 Levesque ..... A43C 1/06 24/712
2018/0055148 A1* 3/2018 Finley ..... A43C 9/06

* cited by examiner

*Primary Examiner* — Kien T Nguyen
(74) *Attorney, Agent, or Firm* — POLSINELLI PC

(57) ABSTRACT

A magic kit and methods of use thereof are described. The magic kit may include three pairs of shoelaces, each shoelace in each pair having a magnetic end and an aglet end, and at least one shoelace having two aglet ends. The magic kit may be used to perform a magic trick where the shoelaces are removably coupled and uncoupled from each other.

18 Claims, 16 Drawing Sheets

MAGNETIC SHOELACES AND METHOD OF USE

FIELD

The present disclosure relates generally to a magic kit with magnetic shoelaces to be used in a magic trick. In at least one example, the present disclosure relates to a magic kit with three pairs of shoelaces, each shoelace in each pair having an aglet end and a magnetic end, and a shoelace having two aglet ends.

BACKGROUND

Magicians often perform magic tricks in close proximity to observers. The magician may want to have shoelaces which can be removably coupled with each other to perform various magic tricks. However, pairs of magnetic shoelaces have not previously been prepared in a way that could be conveniently used in a magic trick in close proximity to observers and packaged in a kit.

As presented herein, a magic kit has been developed to overcome these problems.

BRIEF SUMMARY

Provided herein is a magic kit that includes three pairs of shoelaces, each shoelace in a pair having a magnetic end and an aglet end, and a shoelace having two aglet ends. The magic kit may include further pairs of shoelaces having a magnetic end and an aglet end or further shoelaces having two aglet ends.

An aspect of the present disclosure provides a magic kit that may include a first pair of shoelaces, a second pair of shoelaces, a third pair of shoelaces, and a shoelace. Each shoelace in the first, second, and third pairs of shoelaces may have a magnetic end and an aglet end.

In some aspects, the magnetic ends of each shoelace in each pair may be configured to removably couple to each other. In additional aspects, the first and second pairs of shoelaces may have the same length. In another aspect, the magic kit may include a second shoelace having two aglet ends.

In a further aspect, the first and second pairs of shoelaces may each have a length of about 210 mm to about 300 mm when connected. The third pair of shoelaces may have a length of 400 mm to about 600 mm when connected. The shoelaces with two aglet ends may have a length of about 800 mm to about 1200 mm.

In an additional aspect, the magic kit may be packaged in a packaging configured to hold the three pairs of shoelaces and the shoelace having two aglet ends. In a further aspect, the packaging may be configured to hold the three pairs of shoelaces and the two shoelaces having two aglet ends. In an aspect, the magic kit may further include a ring. In a further aspect, the magic kit may further include a shoe. In another aspect, the magic kit may further include a second shoe.

Further provided herein is a method of performing a magic trick. The method may include lacing a first pair of shoelaces through a first set of eyelets of a shoe, lacing a second pair of shoelaces through a last set of eyelets of the shoe, lacing a single shoelace with two aglet ends from a second set of eyelets of the shoe to a second to last set of eyelets of the shoe, tying a third pair of shoelaces into a bow, and connecting the magnetic ends of the third pair of shoelaces to the magnetic ends of the second pair of shoelaces. Each shoelace in the first pair may include a magnetic end and an aglet end, each shoelace in the second pair may include a magnetic end and an aglet end, and each shoelace in the third pair may include a magnetic end and an aglet end.

In some aspects, the method may further include removing the third pair of shoelaces from the second pair of shoelaces, and connecting the magnetic ends of the third pair of shoelaces to the magnetic ends of the first pair of shoelaces. In other aspects, the method may further include removing the third pair of shoelaces from the first pair of shoelaces and connecting the magnetic ends of the third pair of shoelaces to the magnetic ends of the second pair of shoelaces. In additional aspects, the method may further include inserting a ring between the magnetic ends of the first pair of shoelaces, removing the third pair of shoelaces from the second pair of shoelaces, and connecting the magnetic ends of the third pair of shoelaces to the magnetic ends of the first pair of shoelaces. In another aspect, the method may further include untying the bow of the third pair of shoelaces and sliding the ring off one of the aglet ends of the third pair of shoelaces. In a further aspect, the aglet ends of the shoelace with two aglet ends may be hidden within the shoe. The aglet ends of the first pair of shoelaces may be hidden within the shoe. The aglet ends of the second pair of shoelaces may be hidden within the shoe.

Further provided herein is a method for performing a magic trick, where the method may include lacing a first pair of shoelaces through a last set of eyelets of a first shoe, lacing a single shoelace having two aglet ends from a first set of eyelets of the first shoe to a second to last set of eyelets of the first shoe; lacing a second pair of shoelaces through a first set of eyelets of a second shoe, lacing another single shoelace having two aglet ends from a second set of eyelets of the second shoe to a last set of eyelets of the second shoe, tying the aglet ends of the other shoelace having two aglet ends into a bow, tying a third pair of shoelaces into a bow, and connecting the magnetic ends of the third pair of shoelaces to the magnetic ends of the first pair of shoelaces. Each shoelace in the first pair may include a magnetic end and an aglet end, each shoelace in the second pair may include a magnetic end and an aglet end, and each shoelace in the third pair may include a magnetic end and an aglet end.

In another aspect, the method may further include removing the third pair of shoelaces from the first pair of shoelaces; and connecting the magnetic ends of the third pair of shoelaces to the magnetic ends of the second pair of shoelaces.

Other aspects and iterations of the invention are described more thoroughly below.

BRIEF DESCRIPTION OF THE DRAWINGS

Implementations of the present technology will now be described, by way of example only, with reference to the attached figures, wherein.

DETAILED DESCRIPTION

Figure 1:
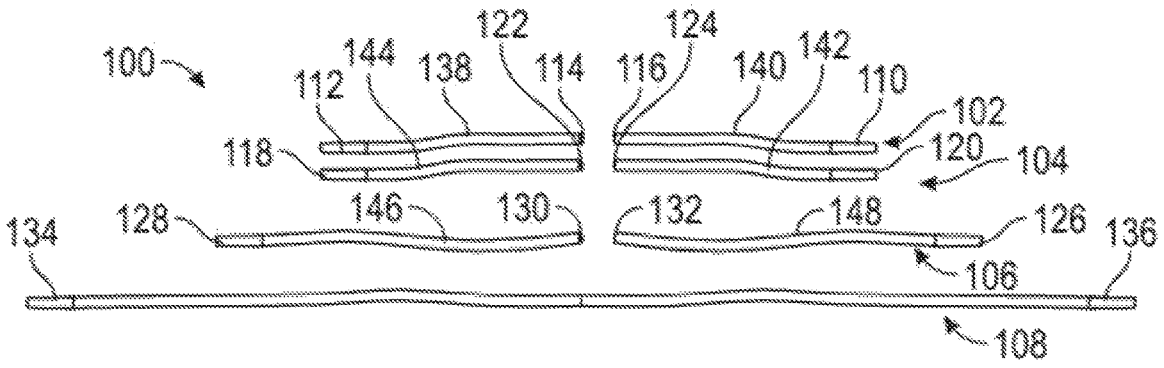
FIG. 1 is an example of the magic kit.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout the above disclosure will now be presented. As used herein, "about" refers to numeric values, including whole numbers, fractions, percentages, etc., whether or not explicitly indicated. The term "about" generally refers to a range of numerical values, for instance, ±0.5-1%, ±1-5% or ±5-10% of the recited value, that one would consider equivalent to the recited value, for example, having the same function or result.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, "substantially cylindrical" means that the object resembles a cylinder but can have one or more deviations from a true cylinder.

The terms "comprising," "including" and "having" are used interchangeably in this disclosure. The terms "comprising," "including" and "having" mean to include, but not necessarily be limited to the things so described.

Provided herein is a magic kit for use in magic tricks. When performing magic tricks in close proximity to observers, it is often desirable to have props that can be moved into different configurations without an observer noticing how the props move between configurations. For example, a magician may want to have shoelaces having magnetic ends. The magnetic ends may allow the magician to remove shoelaces from a shoe in one or more locations, without an observer realizing that what appears to be one shoelace actually has multiple pairs of magnetic shoelaces within it. The magnetic ends may be located in between the aglet ends of a shoelace, therefore allowing a magician to break what appears to be one single, continuous shoelace into multiple smaller parts. The magician may use the magnetic shoelaces to move certain components, such as a bow, from one location on the shoe to another location on the shoe. The magician may also be able to insert objects within the shoelace, such as a ring, without an observer realizing how the object was inserted. The observer may be surprised by the magic trick because it appears that the magician can manipulate a single, continuous shoelace.

As illustrated in FIG. 1, the magic kit 100 may have a first shoelace 138, a second shoelace 140, a third shoelace 144, a fourth shoelace 142, a fifth shoelace 146, a sixth shoelace 148, and a seventh shoelace 108. The first shoelace 138 may have an aglet end 112 and a magnetic end 114. The second shoelace 140 may have an aglet end 110 and a magnetic end 116. The third shoelace 144 may have an aglet end 118 and a magnetic end 122. The fourth shoelace 142 may have an aglet end 120 and a magnetic end 124. The fifth shoelace 146 may have an aglet end 128 and a magnetic end 130. The sixth shoelace 148 may have an aglet end 126 and a magnetic end 132. The seventh shoelace 108 may have a first aglet end 134 and a second aglet end 136.

In some embodiments, the first shoelace 138 and the second shoelace 140 may form a first pair 102 of shoelaces. The third shoelace 144 and the fourth shoelace 142 may form a second pair 104 of shoelaces. The fifth shoelace 146 and the sixth shoelace 148 may form a third pair 106 of shoelaces.

Figure 2:
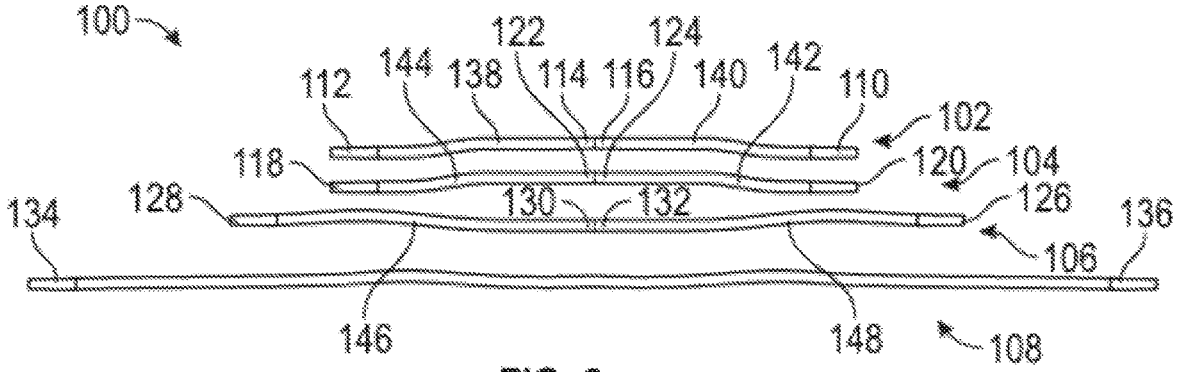
FIG. 2 is an example of the magic kit.

The polarity of the magnetic end 114 of the first shoelace 138 may be opposite the polarity of the magnetic end 116 of the second shoelace 140. As illustrated in FIG. 2, the magnetic end 114 of the first shoelace 138 may be configured to removably couple to the magnetic end 116 of the second shoelace 140. The polarity of the magnetic end 122 of the third shoelace 144 may be opposite of the polarity of the magnetic end 124 of the fourth shoelace 142. As illustrated in FIG. 2, the magnetic end 122 of the third shoelace 144 may be configured to removably couple to the magnetic end 124 of the fourth shoelace 142. The polarity of the magnetic end 130 of the fifth shoelace 146 may be opposite the polarity of the magnetic end 132 of the sixth shoelace 148. As illustrated in FIG. 2, the magnetic end 130 of the fifth shoelace 146 may be configured to removably couple to the magnetic end 132 of the sixth shoelace 148.

In some embodiments, the magnetic end 114 of the first shoelace 138, the magnetic end 122 of the third shoelace 144, and the magnetic end 130 of the fifth shoelace 146 may be a north pole. The magnetic end 116 of the second shoelace 140, the magnetic end 124 of the fourth shoelace 142, and the magnetic end 132 of the sixth shoelace 148 may be a south pole. In an example, the magnetic end 114 of the first shoelace 138 may be configured to removably couple to the magnetic end 116 of the second shoelace 140, the magnetic end 124 of the fourth shoelace 142, and/or the magnetic end 132 of the sixth shoelace 148. In another example, the magnetic end 122 of the third shoelace 144 may be configured to removably couple to the magnetic end 116 of the second shoelace 140, the magnetic end 124 of the fourth shoelace 142, and/or the magnetic end 132 of the sixth shoelace 148. In a further example, the magnetic end 130 of the fifth shoelace 146 may be configured to removably couple to the magnetic end 116 of the second shoelace 140, the magnetic end 124 of the fourth shoelace 142, and/or the magnetic end 132 of the sixth shoelace 148.

As illustrated in FIG. 2, the first pair 102 of shoelaces and the second pair 104 of shoelaces may have the same length. The length of the first pair 102 of shoelaces may be defined as the length of the first pair 102 of shoelaces when the magnetic end 114 of the first shoelace 138 is removably coupled to the magnetic end 116 of the second shoelace 140. The length of the second pair 104 of shoelaces may be defined as the length of the second pair 104 of shoelaces when the magnetic end 122 of the third shoelace 144 is removably coupled to the magnetic end 124 of the fourth shoelace 142. In some examples, the first pair 102 of shoelaces may have a length of about 100 mm, about 125 mm, about 150 mm, about 175 mm, about 200 mm, about 225 mm, about 250 mm, about 275 mm, about 300 mm, about 325 mm, about 350 mm, about 375 mm, or about 400 mm. In some examples, the first pair 102 of shoelaces may have a length of about 100 mm to about 125 mm, about 125 mm to about 150 mm, about 150 mm to about 175 mm, about 175 mm to about 200 mm, about 200 mm to about 225 mm, about 225 mm to about 250 mm, about 250 mm to about 275 mm, about 275 mm to about 300 mm, about 300 mm to about 325 mm, about 325 mm to about 350 mm, about 350 mm to about 375 mm, or about 375 mm to about 400 mm. In some examples, the second pair 104 of shoelaces may have a length of about 100 mm, about 125 mm, about 150 mm, about 175 mm, about 200 mm, about 225 mm, about 250 mm, about 275 mm, about 300 mm, about 325 mm, about 350 mm, about 375 mm, or about 400 mm. In some examples, the second pair 104 of shoelaces may have a length of about 100 mm to about 125 mm, about 125 mm to about 150 mm, about 150 mm to about 175 mm, about 175 mm to about 200 mm, about 200 mm to about 225 mm, about 225 mm to about 250 mm, about 250 mm to about 275 mm, about 275 mm to about 300 mm, about 300 mm to about 325 mm, about 325 mm to about 350 mm, about 350 mm to about 375 mm, or about 375 mm to about 400 mm. In one example, the first pair 102 of shoelaces and the second pair 104 of shoelaces may have a length of about 210 mm to about 300 mm.

As illustrated in FIG. 2, the third pair 106 of shoelaces may be longer than the first pair 102 of shoelaces and the second pair 104 of shoelaces. The length of the third pair 106 of shoelaces may be defined as the length of the third pair 106 of shoelaces when the magnetic end 130 of the fifth shoelace 146 is removably coupled to the magnetic end 132 of the sixth shoelace 148. In some examples, the third pair 106 of shoelaces may have a length of about 300 mm, about 325 mm, about 350 mm, about 375 mm, about 400 mm, about 425 mm, about 450 mm, about 475 mm, about 500 mm, about 525 mm, about 550 mm, about 575 mm, about 600 mm, about 625 mm, about 650 mm, about 675 mm, or about 700 mm. In some examples, the third pair 106 of shoelaces may have a length of about 300 mm to about 325 mm, about 325 mm to about 350 mm, about 350 mm to about 375 mm, about 375 mm to about 400 mm, about 400 mm to about 425 mm, about 425 mm to about 450 mm, about 450 mm to about 475 mm, about 475 mm to about 500 mm, about 500 mm to about 525 mm, about 525 mm to about 550 mm, about 550 mm to about 575 mm, about 575 mm to about 600 mm, about 600 mm to about 625 mm, about 625 mm to about 650 mm, about 650 mm to about 675 mm, or about 675 mm to about 700 mm.

As illustrated in FIG. 2, the seventh shoelace 108 may be longer than the first pair 102 of shoelaces, the second pair 104 of shoelaces, and the third pair 106 of shoelaces. In some examples, the seventh shoelace 108 may have a length of about 600 mm, about 625 mm, about 650 mm, about 675 mm, about 700 mm, about 725 mm, about 750 mm, about 775 mm, about 800 mm, about 825 mm, about 850 mm, about 875 mm, about 900 mm, about 925 mm, about 950 mm, about 975 mm, or about 1000 mm. In some examples, the seventh shoelace 108 may have a length of about 600 mm to about 625 mm, about 625 to about 650 mm, about 650 mm to about 675 mm, about 675 mm to about 700 mm, about 700 mm to about 725 mm, about 725 mm to about 750 mm, about 750 mm to about 775 mm, about 775 mm to about 800 mm, about 800 mm to about 825 mm, about 825 mm to about 850 mm, about 850 mm to about 875 mm, or about 875 mm to about 900 mm.

In some embodiments, the magnetic ends of each shoelace may have a magnet within the outer surface of each shoelace. Each magnet may be configured to stay removably coupled when provided a low force (e.g., the swinging or kicking of a shoe). In some examples, each magnet may be configured to easily uncouple when provided with a force (e.g., a hand pressing down or pulling the magnets apart). In an example, the magnetic ends of the first pair 102 of shoelaces, the second pair 104 of shoelaces, or the third pair 106 of shoelaces may be configured to uncouple to receive a ring and then immediately recouple. In another example, the magnetic ends of the first pair 102 of shoelaces may be configured to immediately recouple to each other when they are uncoupled from the magnetic ends of the third pair 106 of shoelaces. The magnetic ends of the second pair 104 of shoelaces may be configured to immediately recouple to each other when they are uncoupled from the magnetic ends of the third pair of shoelaces. The magnetic ends of the pairs of shoelaces may be configured such that an observer never sees the magnetic ends uncoupled.

Figure 3:
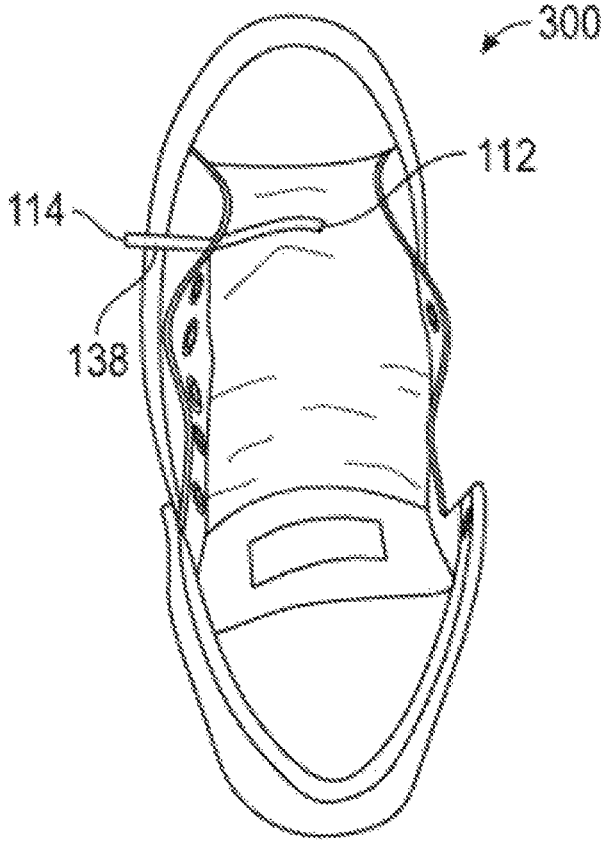
FIG. 3 is a top view of a shoelace being installed onto a shoe in an example.
Figure 4:
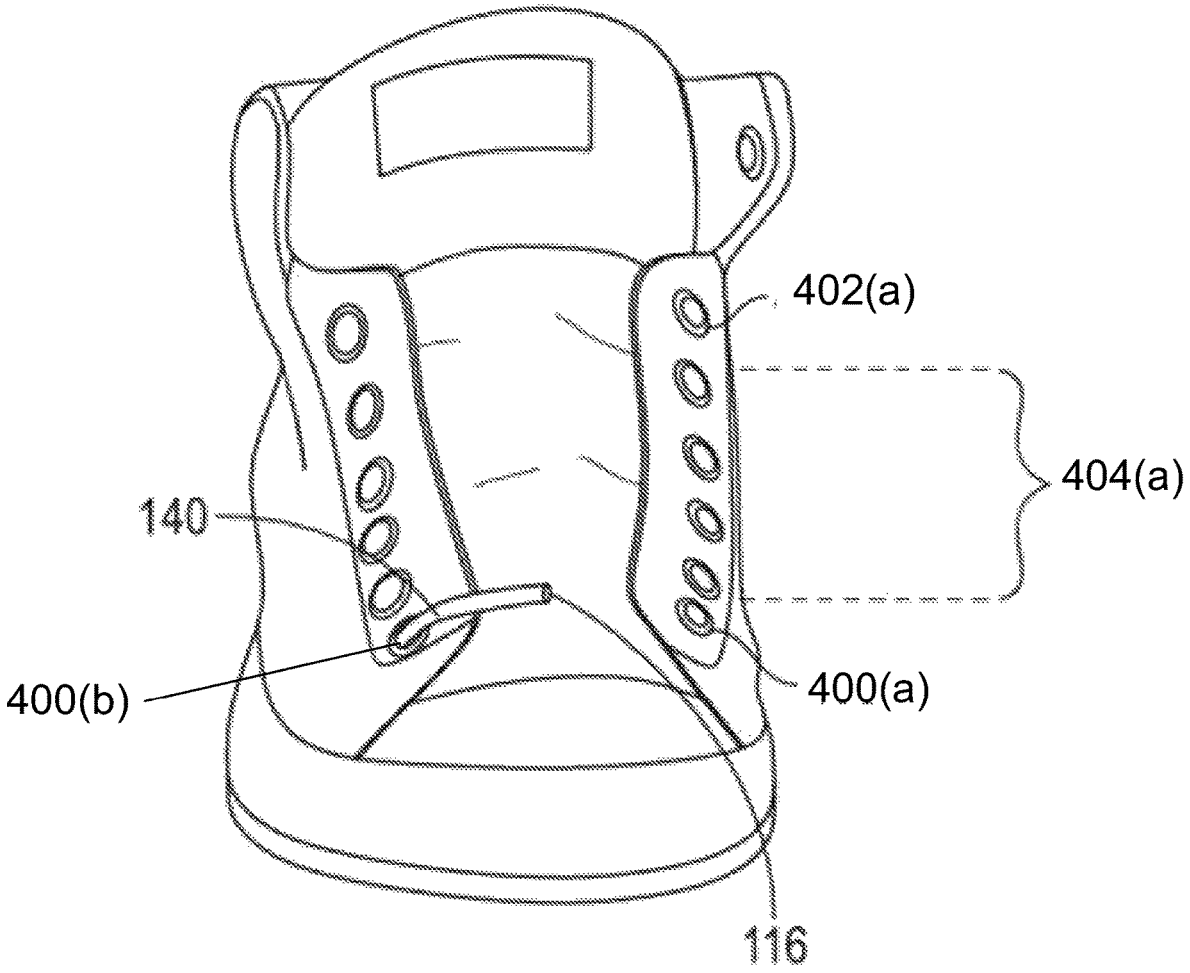
FIG. 4 is a front view of a shoelace being installed onto a shoe in an example.

As illustrated in FIGS. 3-7, the first pair 102 of shoelaces, the second pair 104 of shoelaces, the third pair 106 of shoelaces, and the seventh shoelace 108 may be configured to be laced through eyelets of a shoe 300. As illustrated in FIG. 3, the first shoelace 138 may be laced through a first eyelet 400(*a*) in a first set of eyelets (e.g., the eyelets closest to the toe of the shoe) of the shoe 300. The aglet end 112 of the first shoelace 138 may be inserted through a first eyelet 400(*a*) of the first set of eyelets 400. The magnetic end 114 of the first shoelace 138 may hang out of the first eyelet 400(*a*) of the first set of eyelets 400. As illustrated in FIG. 4, the magnetic end 116 of the second shoelace 140 may be placed at a point about halfway between first eyelet 400(*a*) and the second eyelet 400(*b*) of the first set of eyelets 400. The shoe may have a last set of eyelets 402 (e.g., 402(*b*) and 402(*a*)). The shoe 300 may have intermediate sets of eyelets 404 (e.g., 404(*a*) and 404(*b*)) between the first set of eyelets 400 and the last set of eyelets 402. As illustrated in FIG. 4, the aglet end 110 of the second shoelace 140 may be hidden within the shoe, such that it is not visible to an observer.

Figure 5:
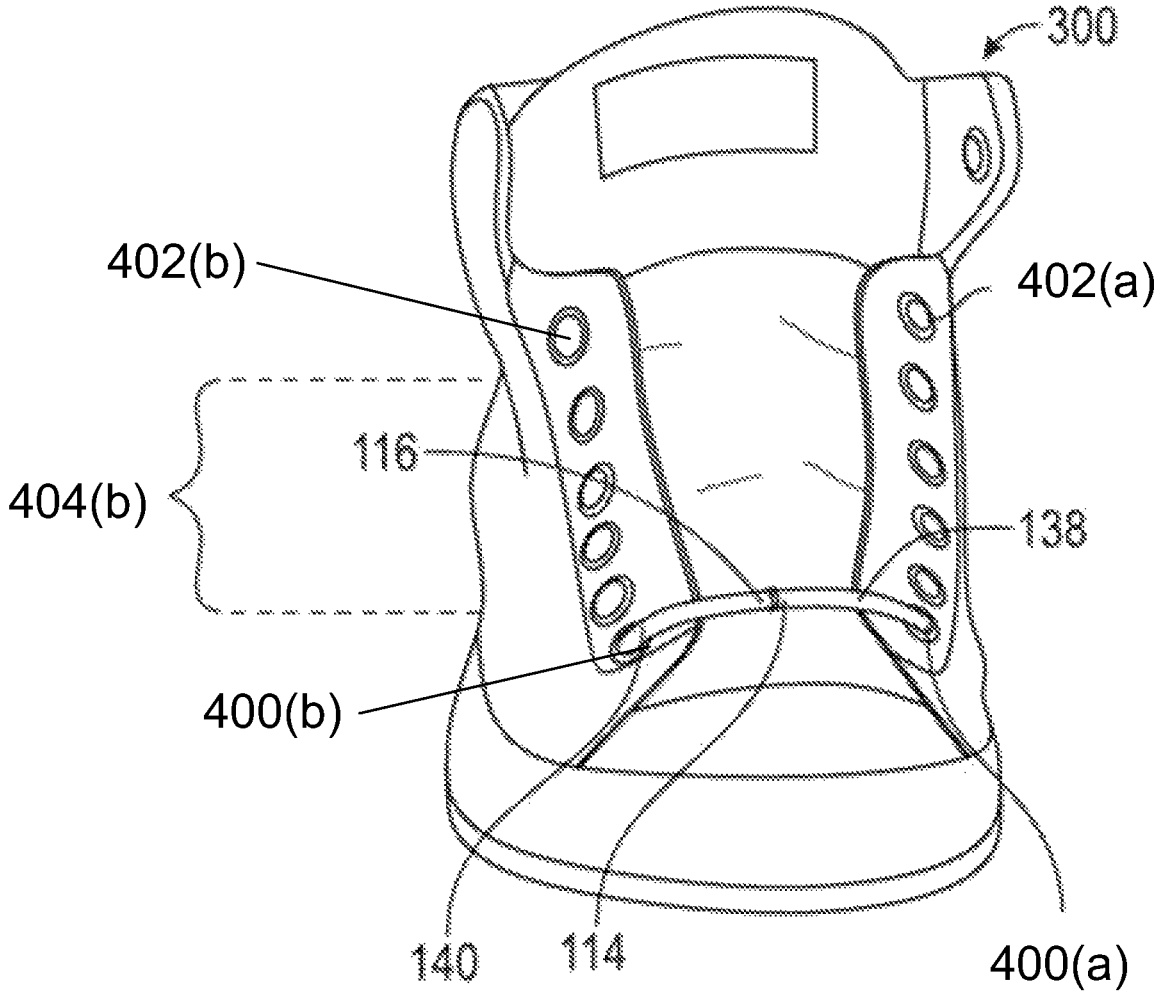
FIG. 5 is a front view of two shoelaces being installed onto a shoe in an example.

As illustrated in FIG. 5, after the aglet end 112 of the first shoelace 138 is laced through the first eyelet 400(*a*) of the first set of eyelets 400 and the aglet end 110 of the second shoelace 140 is laced through the second eyelet 400(*b*) of the first set of eyelets 400, the magnetic end 114 of the first shoelace 138 may be removably coupled to the magnetic end 116 of the second shoelace 140. As illustrated in FIG. 5, the aglet end 112 of the first shoelace 138 and the aglet end 110 of the second shoelace 140 may be hidden within the shoe 300, such that they are not visible to an observer.

Figure 6:
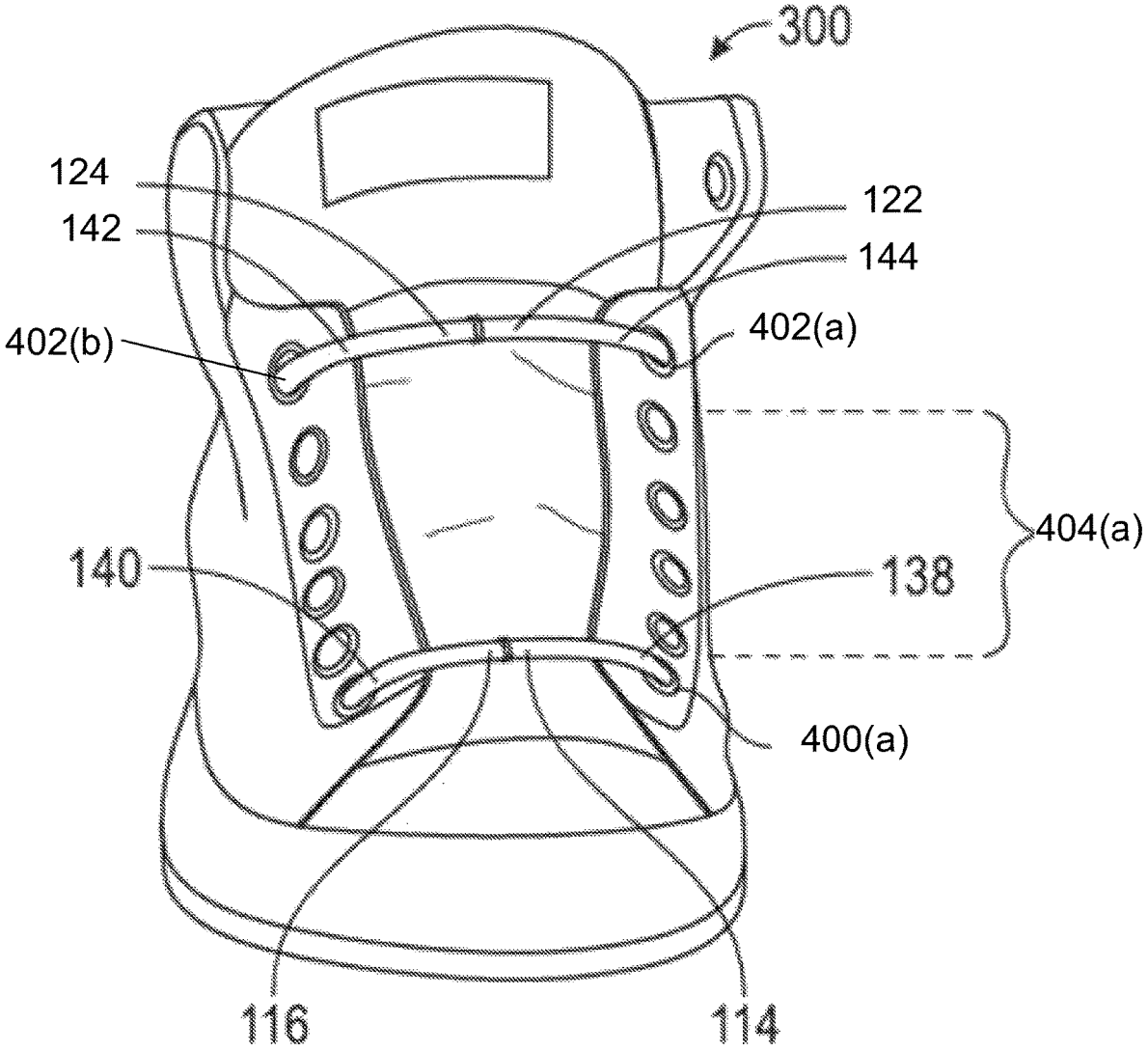
FIG. 6 is a front view of four shoelaces being installed onto a shoe in an example.

As illustrated in FIG. 6, the second pair 104 of shoelaces may be laced through a last set of eyelets 402 (i.e., 402(*a*), 402(*b*)). The aglet end 118 of the third shoelace 144 may be laced through the first eyelet 402(*a*) of the last set of eyelets 402. The aglet end 120 of the fourth shoelace 142 may be laced through the second eyelet 402(*b*) of the last set of eyelets 402. The aglet ends 118, 120 of the third shoelace 144 and the fourth shoelace 142 may be hidden within the shoe, such that they are not visible to an observer. The magnetic end 122 of the third shoelace 144 may be removably coupled to the magnetic end 124 of the fourth shoelace 142, as illustrated, for example, in FIG. 6.

Figure 7:
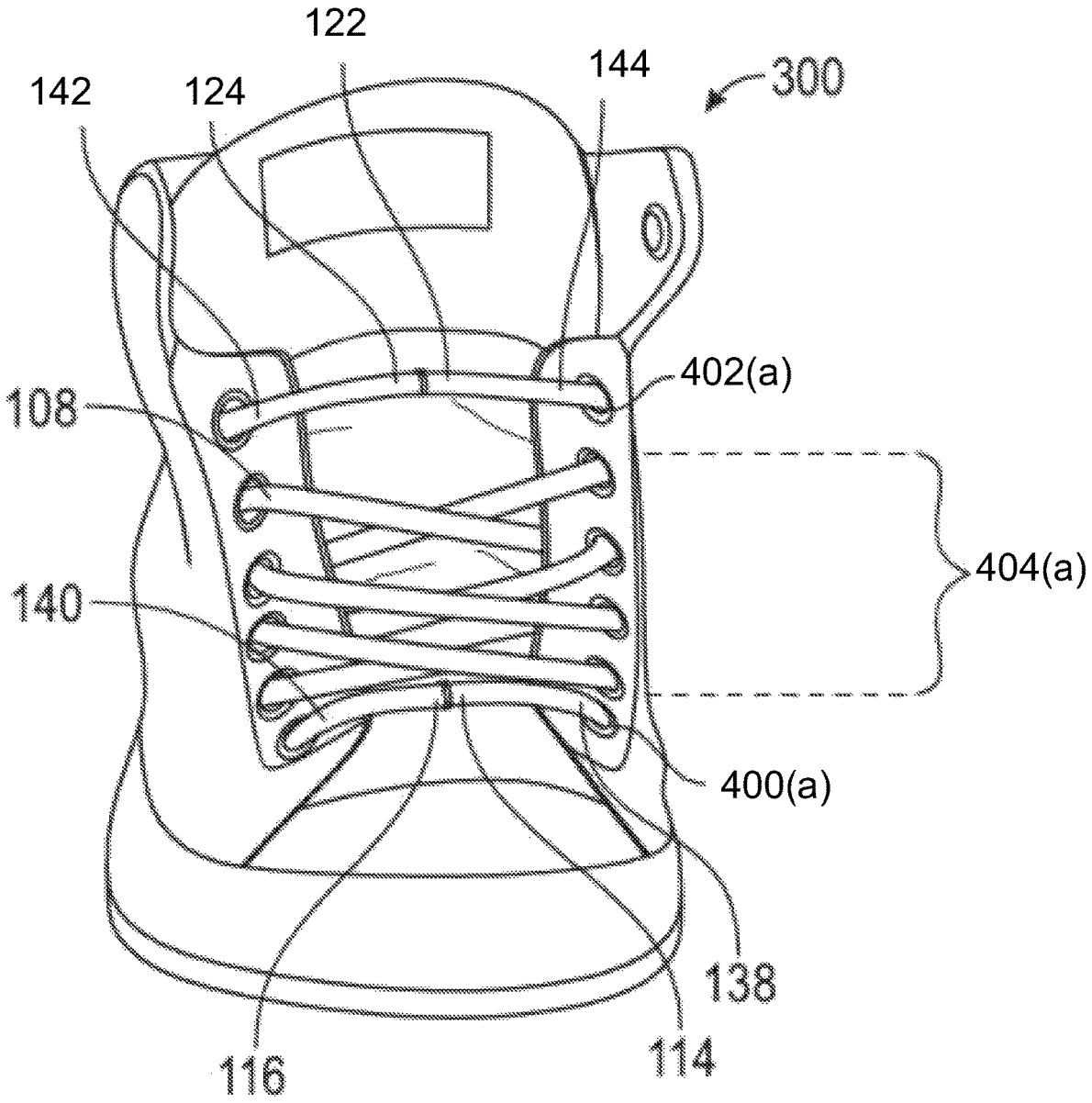
FIG. 7 is a front view of five shoelaces being installed onto a shoe in an example.

As illustrated in FIG. 7, the seventh shoelace 108 may be laced through the intermediate sets of eyelets 404 (i.e., 404(*a*), 404(*b*)) of the shoe 300. The aglet ends 134, 136 of the seventh shoelace 108 may be hidden within the shoe 300, such that they are not visible to an observer.

Figure 8:
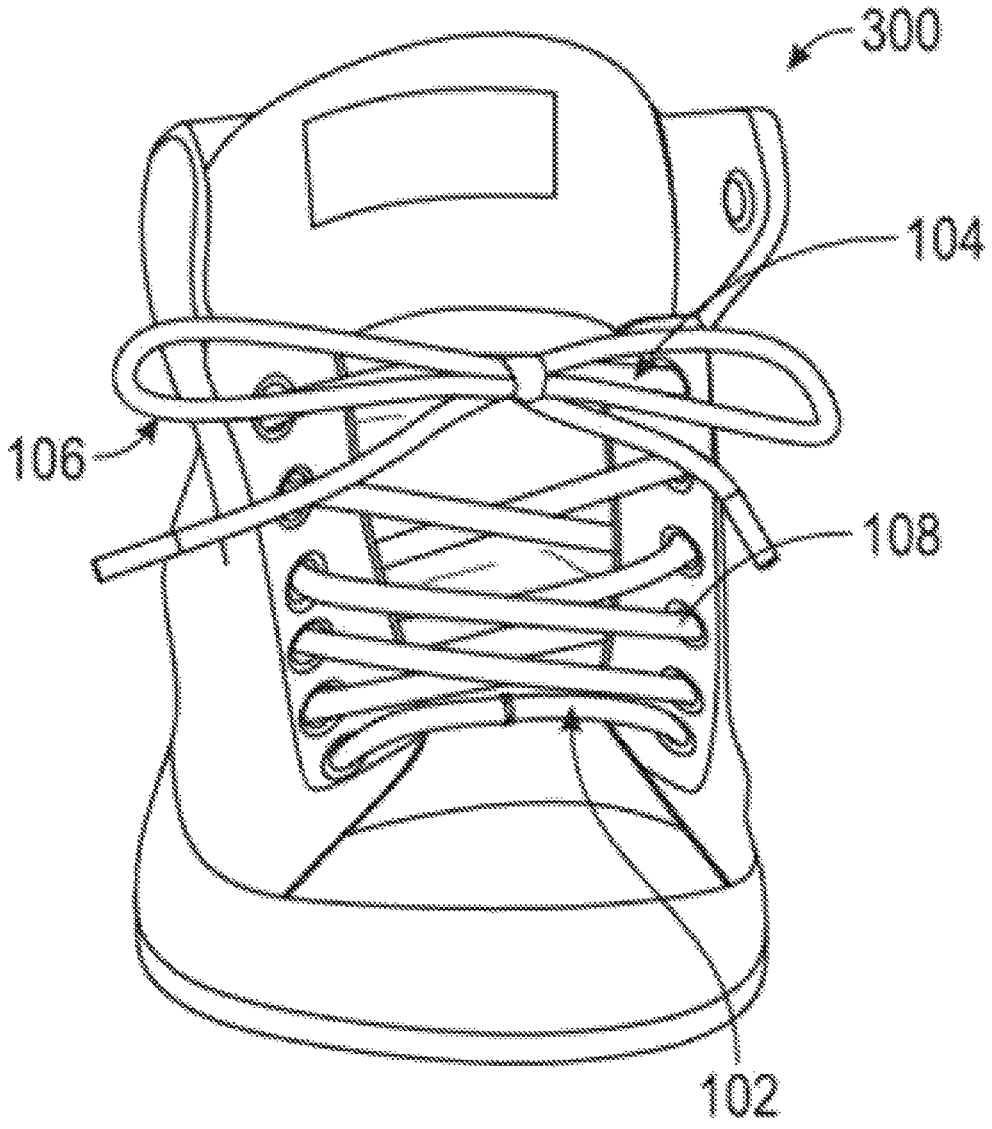
FIG. 8 is a front view of a shoelace configuration in one example.
Figure 10:
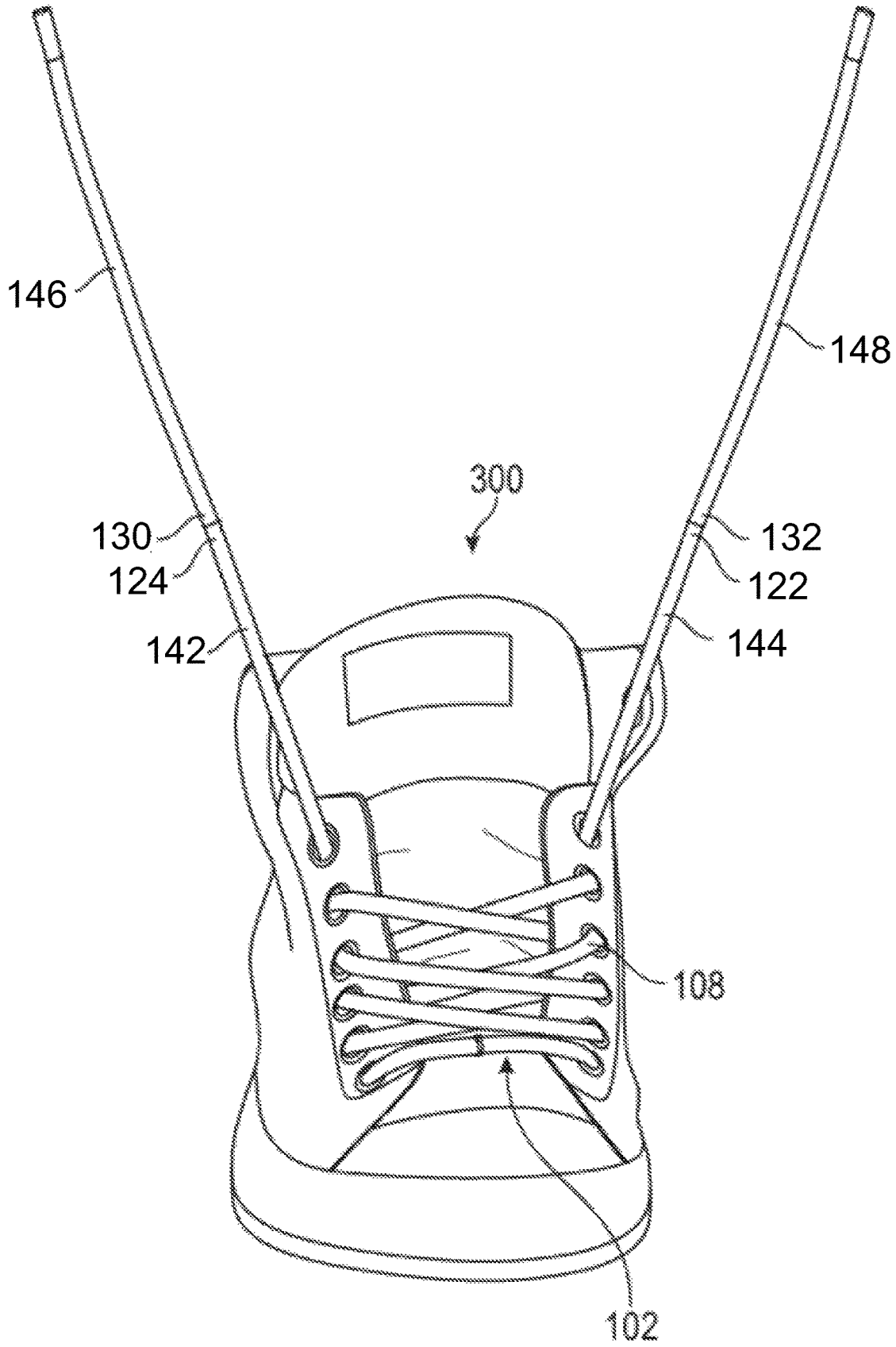
FIG. 10 is a front view of a shoelace configuration in one example.
Figure 11:
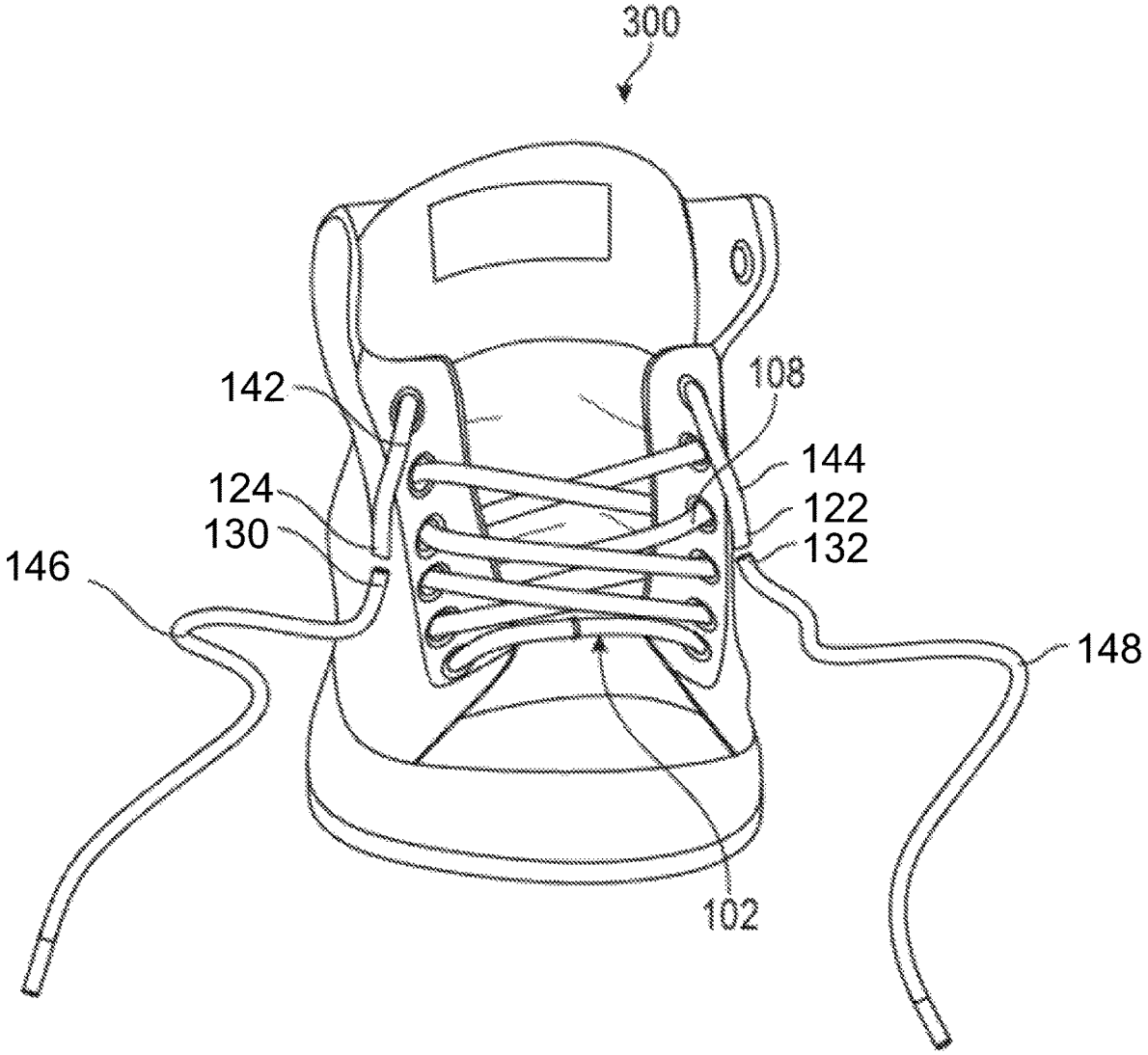
FIG. 11 is a front view of a shoelace configuration in one example.

As illustrated in FIG. 8, the third pair 106 of shoelaces may be tied into a bow. The third pair 106 of shoelaces may be removably coupled to the magnetic ends of the second pair 104 of shoelaces. As illustrated in FIG. 10, the magnetic end 130 of the fifth shoelace 146 may be removably coupled to the magnetic end 124 of the fourth shoelace 142. The magnetic end 132 of the sixth shoelace 148 may be removably coupled to the magnetic end 122 of the third shoelace 144. This configuration of the shoelaces may make the shoelaces appear to be one single, continuous shoelace to an observer. As illustrated in FIG. 10, when the bow of the third pair 106 of shoelaces is untied while the third pair 106 of shoelaces is connected to the second pair 104 of shoelaces, the shoe 300 appears to be a normal shoe with one single, continuous shoelace. FIG. 11 illustrates the third pair 106 of shoelaces uncoupled from the second pair 104 of shoelaces.

Figure 9:
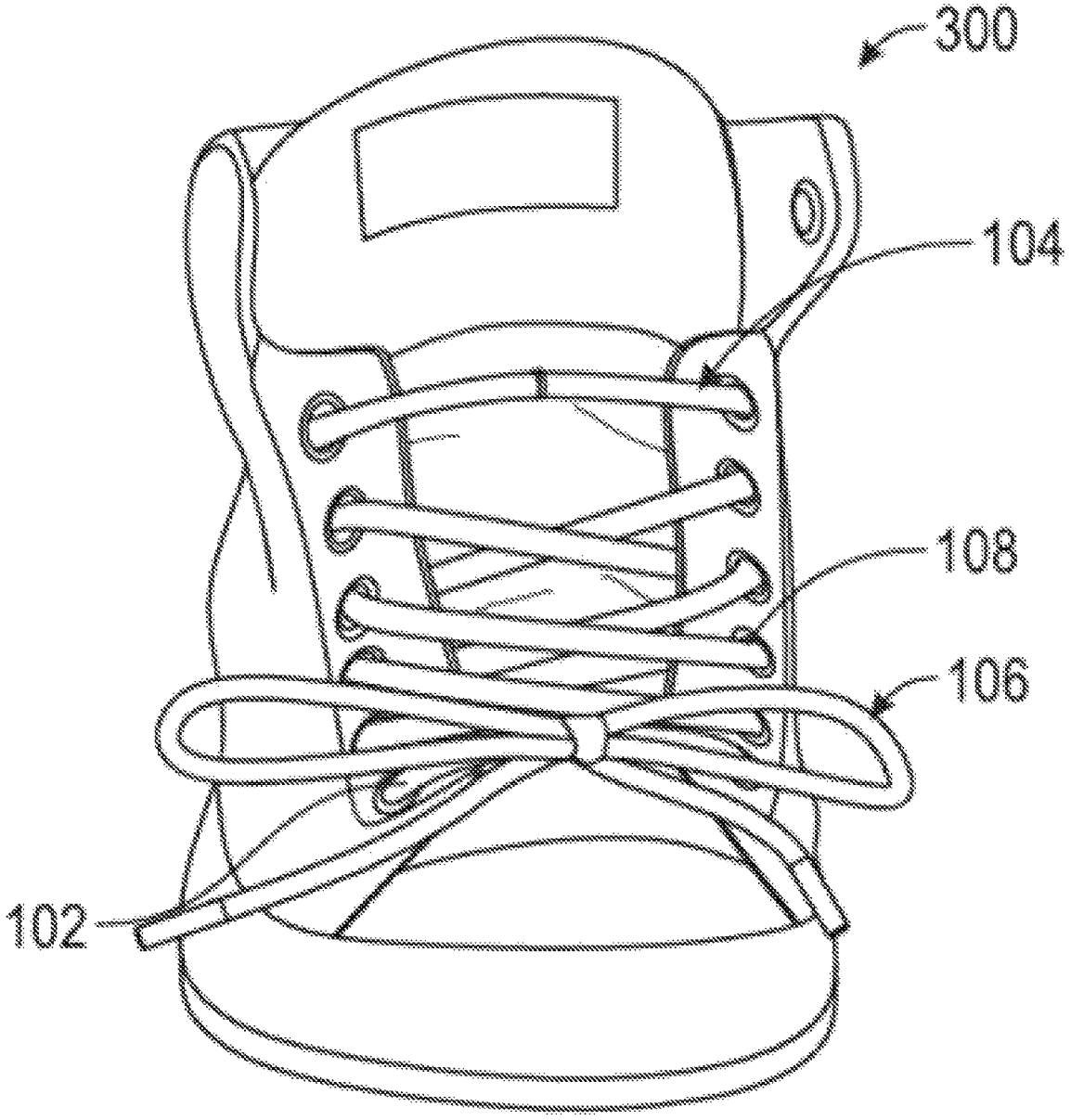
FIG. 9 is a front view of a shoelace configuration in one example.

As illustrated in FIG. 9, the bow of the third pair 106 of shoelaces may be moved from the second pair 104 of shoelaces to the first pair 102 of shoelaces without untying the bow. The magnetic ends of the third pair 106 of shoelaces may be removably coupled to the magnetic ends of the first pair 102 of shoelaces. When the third pair 106 of shoelaces is uncoupled from the second pair 104 of shoelaces, the magnetic ends of the second pair 104 of shoelaces may immediately recouple to each other.

Figure 15:
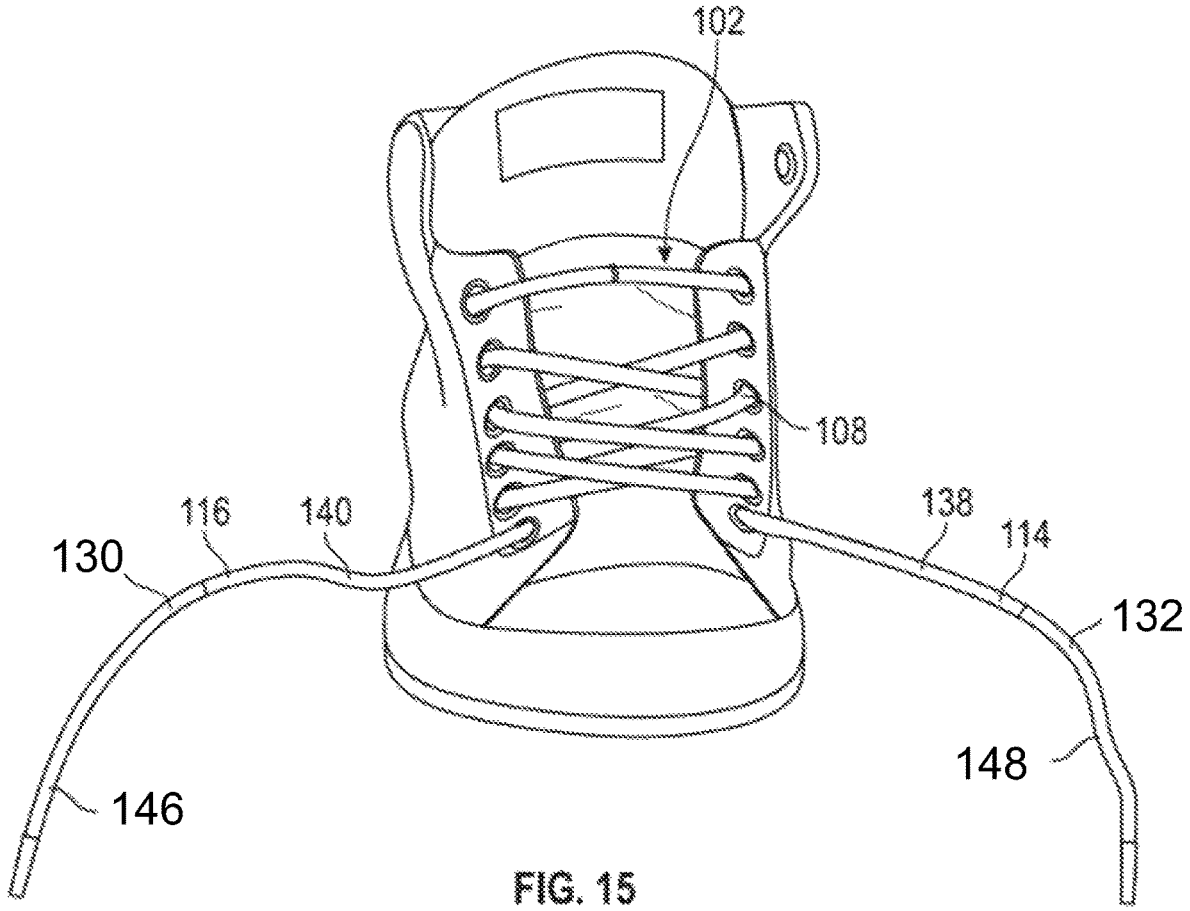
FIG. 15 is a shoelace configuration in one example.

As illustrated in FIG. 15, the third pair 106 of shoelaces may be connected to the first pair 102 of shoelaces by removably coupling the magnetic end 130 of the fifth shoelace 146 to the magnetic end 116 of the second shoelace 140 and removably coupling the magnetic end 132 of the sixth shoelace 148 to the magnetic end 114 of the first shoelace 138. The bow may be untied revealing a shoe 300 that appears to have shoelaces laced backwards (e.g., in a reverse direction from "normal" laces as illustrated in FIG. 10).

Figure 12:
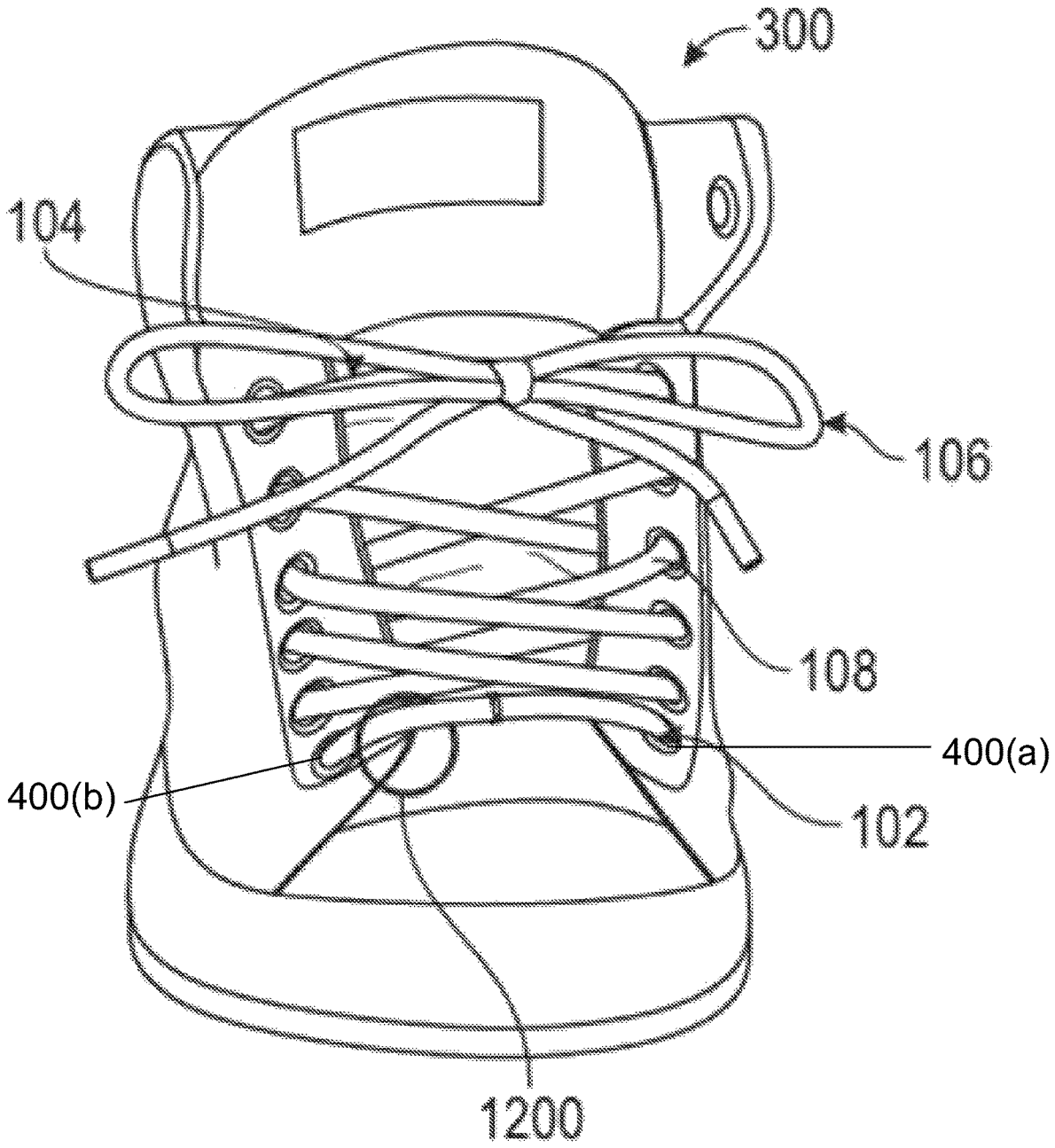
FIG. 12 is a front view of a shoelace configuration with a ring attached in one example.
Figure 13:
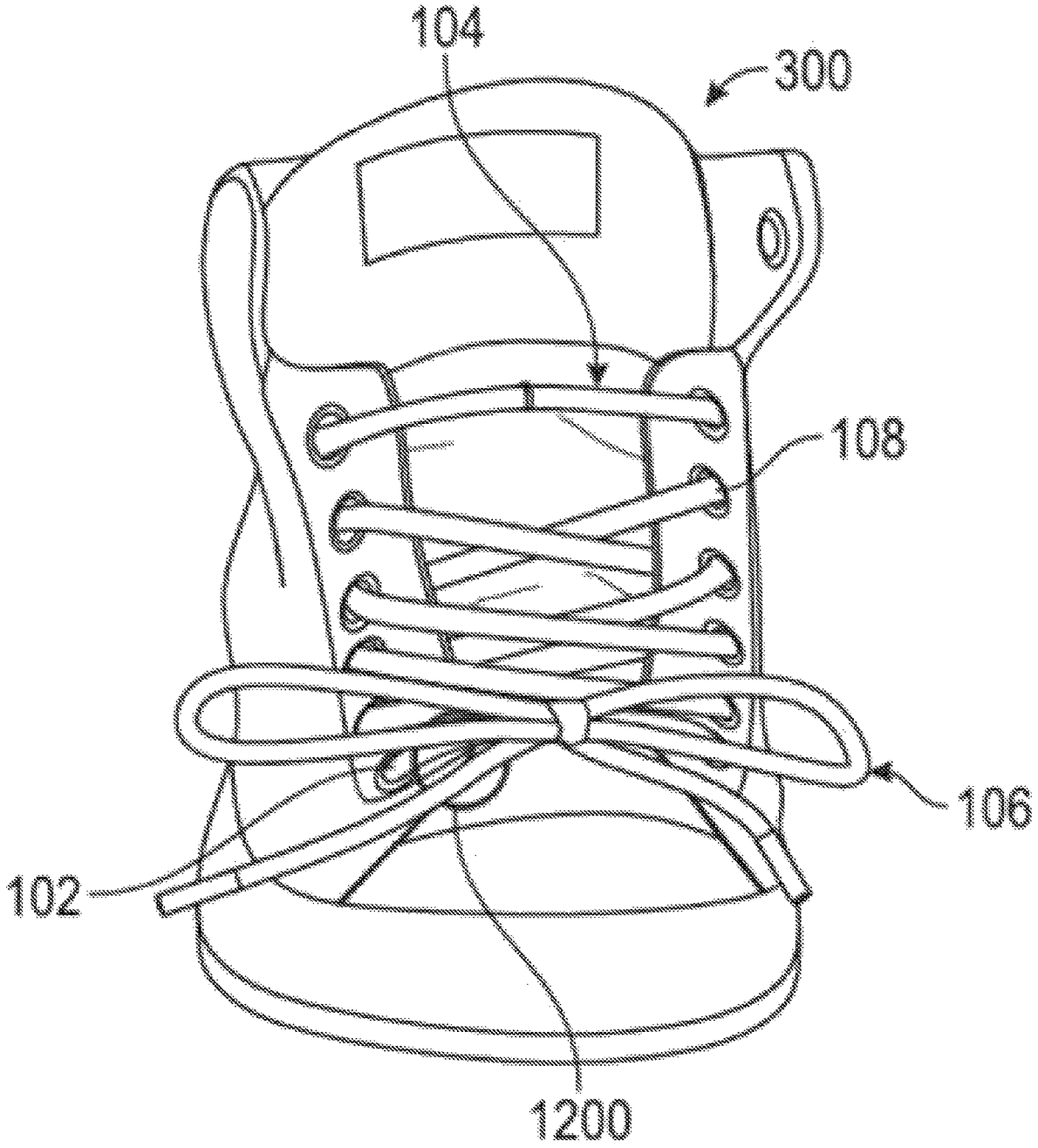
FIG. 13 is a front view of a shoelace configuration with a ring attached in one example.
Figure 14:
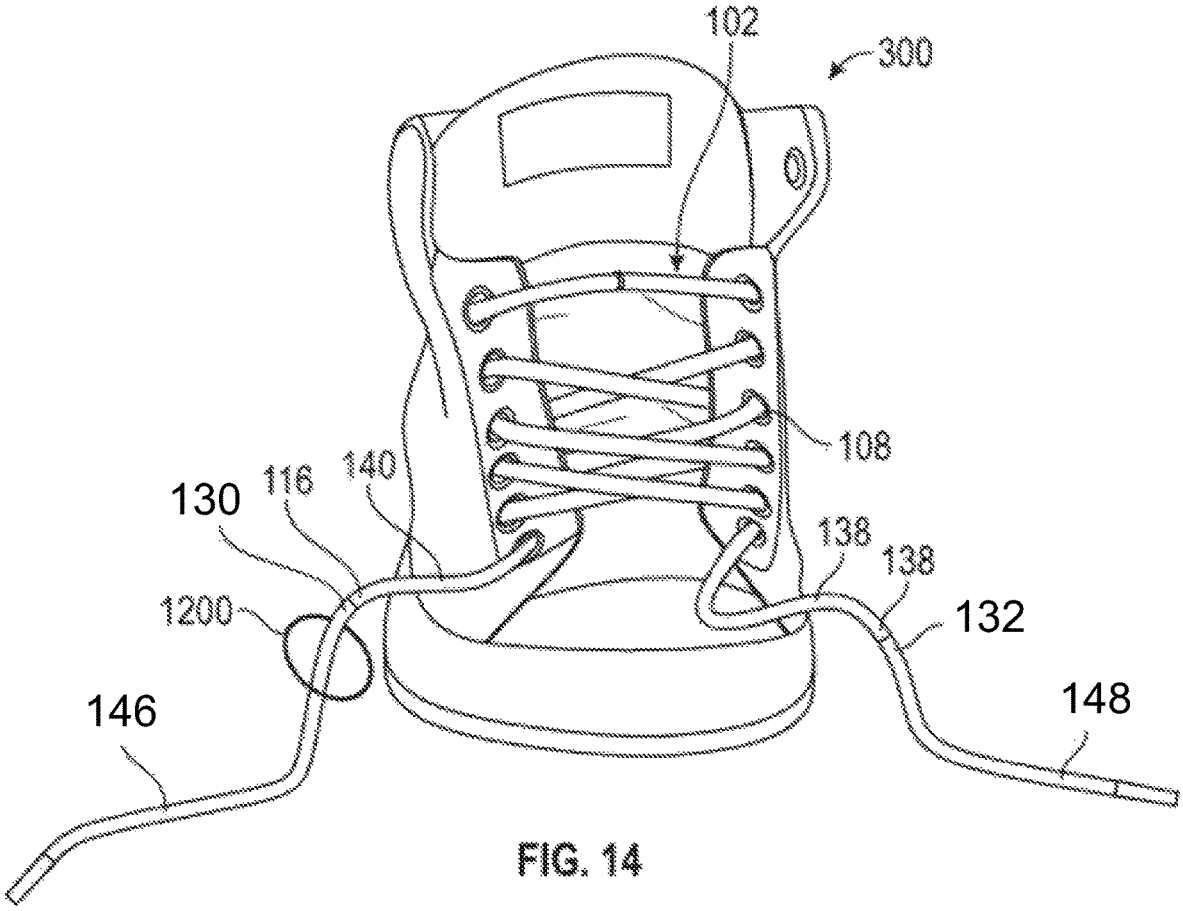
FIG. 14 is a front view of a shoelace configuration with a ring attached in one example.

As illustrated in FIG. 12, a ring 1200 may be inserted on the first pair 102 shoelaces between the magnetic end 114 of the first shoelace 138 and the magnetic end 116 of the second shoelace 140. The magnetic end 114 of the first shoelace 138 and the magnetic end 116 of the second shoelace 140 may uncouple to allow the ring 1200 to be inserted and then immediately recouple, such that it appears to an observer the magnetic ends never uncoupled. The ring 1200 may slide back and forth on the first pair 102 of shoelaces between the first eyelet 400(*a*) of the first set of eyelets 400 and the second eyelet 400(*b*) of the first set of eyelets 400. As illustrated in FIG. 13, the third pair 106 of shoelaces tied into a bow may be uncoupled from the second pair 104 of shoelaces and coupled to the first pair 102 of shoelaces. As illustrated in FIG. 14, the bow of the third pair 106 of shoelaces may be untied and the ring may slide off the either the fifth shoelace 146 or the sixth shoelace 148.

In a further embodiment, the magic kit 100 may further include an eighth shoelace having two aglet ends and configured to be laced to the eyelets of a second shoe. In some embodiments, the magic kit 100 may be packaged in a kit. The shoelaces and a ring may be packaged in a box, a bag, or any other type of storage container. The packaging may be configured to hold the three pairs of shoelaces, the shoelaces having two aglet ends, and a ring.

In further embodiments, the pairs of shoelaces may be laced through different eyelets to perform different tricks. For example, the first pair of shoelaces may be laced to the last set of eyelets (e.g., the eyelets closest to the topline of a shoe where a foot is inserted) of a first shoe. The seventh shoelace may then be laced through the remaining eyelets (e.g., the first set of eyelets closest to the toe through the second to last set of eyelets adjacent to the last set of eyelets) of the first shoe. The second pair of shoelaces may be laced to the first set of eyelets (e.g., the eyelets closest to the toe of a shoe) of a second shoe. An eighth shoelace comprising two aglet ends may be laced from the second set of eyelets (e.g., the eyelets adjacent to the first set of eyelets) to the last set of eyelets (e.g., the eyelets closest to the topline where a foot is inserted into the shoe) of the second shoe. The aglet ends of the eighth shoelace may be tied into a bow, making the second shoe appear to be a normal shoe to an observer. The third pair of laces may be tied into a bow and removably coupled to the first pair of shoelaces on the first shoe, making the first shoe appear to be a normal shoe. The bow of the third pair of shoelaces may then be uncoupled from the first pair of shoelaces and coupled to the second pair of shoelaces, making the second shoe appear to have two bows.

In another embodiment, the first shoelace, second shoelace, third shoelace, fourth shoelace, fifth shoelace, sixth shoelace, seventh shoelace, and eighth shoelace may be laced on one or more shoes in different configurations. The magnetic ends of the first shoelace, second shoelace, third shoelace, fourth shoelace, fifth shoelace, and sixth shoelace may be coupled and uncoupled to perform other various magic tricks.

Figure 16:
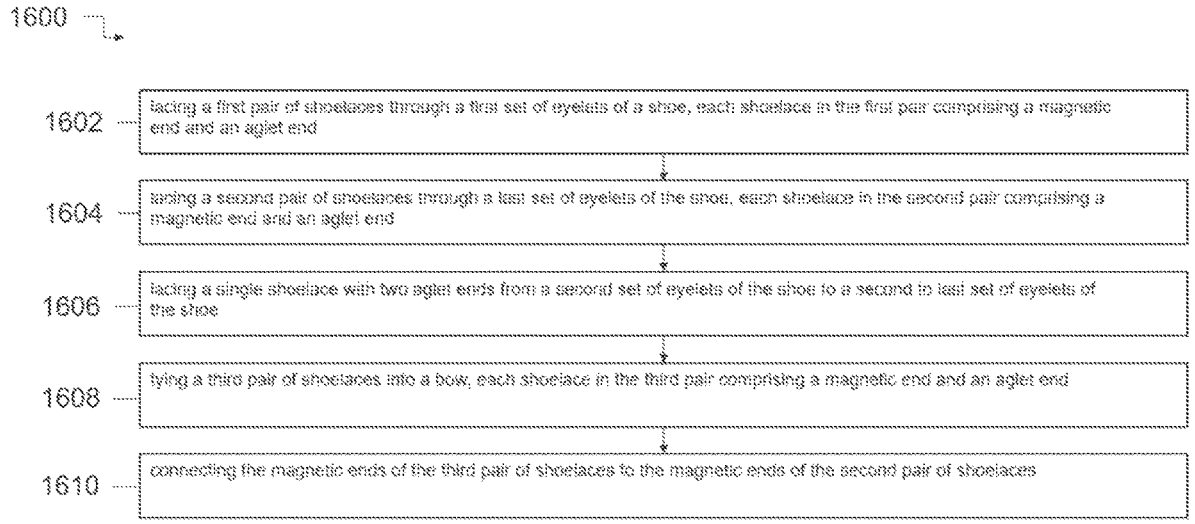
FIG. 16 is a flowchart for a method of performing a magic trick in one example.

Further provided herein is a method of performing a magic trick with a magic kit comprising a first shoelace, second shoelace, third shoelace, fourth shoelace, fifth shoelace, sixth shoelace, and seventh shoelace. As illustrated in FIG. 16, the method 1600 may include multiple steps.

At a first step 1602, the method 1600 may include lacing a first pair of shoelaces through a first set of eyelets of a shoe. The first pair of shoelaces may include the first shoelace having a magnetic end and an aglet end and the second shoelace having a magnetic end and an aglet end. The aglet end of the first shoelace may be placed through one eyelet of the first set of eyelets and the aglet end of the second shoelace may be placed though the other eyelet of the first set of eyelets. The aglet ends of the first shoelace and the second shoelace may be hidden under the tongue of the shoe after they have been placed through the respective eyelets, such that they are not visible to an observer. The magnetic end of the first shoelace may be configured to removably couple to the magnetic end of the second shoelace. The first set of eyelets may be the eyelets on either side of the tongue of a shoe located closest to the toe of the shoe.

At a second step 1604, the method 1600 may include lacing a second pair of shoelaces through a last set of eyelets of a shoe. The second pair of shoelaces may include the third shoelace having a magnetic end and an aglet end and the fourth shoelace having a magnetic end and an aglet end. The aglet end of the third pair of shoelaces may be placed through one eyelet of the last set of eyelets and the aglet end of the fourth shoelace may be placed through the other eyelet of the last set of eyelets. The aglet ends of the third shoelace and the fourth shoelace may be hidden under the tongue of the shoe after they have been placed through the respective eyelets of the last set of eyelets, such that they are not visible to an observer. The magnetic end of the third shoelace may be configured to removably couple to the magnetic end of the fourth shoelace. The last set of eyelets may be the eyelets on either side of the tongue of shoe located closest to the topline (e.g., where a foot is inserted).

At a third step 1606, the method 1600 may include lacing the seventh shoelace having two aglet ends from a second set of eyelets (e.g., the set of eyelets adjacent to the first set of eyelets) to a second to last set of eyelets (e.g., the set of eyelets adjacent to the last set of eyelets). The seventh shoelace may be a single shoelace.

At a fourth step 1608, the method 1600 may include tying a third pair of shoelaces into a bow. The third pair of shoelaces may include the fifth shoelace having a magnetic end and an aglet end and the sixth pair of shoelaces having a magnetic end and an aglet end. The magnetic end of the fifth shoelace may be configured to removably couple to the magnetic end of the second shoelace, the magnetic end of the fourth shoelace, and/or the magnetic end of the sixth shoelace. The magnetic end of the sixth shoelace may be configured to removably couple to the magnetic end of the first shoelace, the magnetic end of the third shoelace, and/or the magnetic end of the fifth shoelace.

At a fifth step 1610, the method 1600 may include connecting the magnetic ends of the third pair of shoelaces to the magnetic ends of the second pair of shoelaces. The magnetic end of the fifth shoelace may be removably coupled to the magnetic end of the fourth shoelace. The magnetic end of the sixth shoelace may be removably coupled to the third shoelace. After completion of the fifth step 1610, the shoe and magic kit may appear to be a normal laced up shoe, as illustrated for example in FIG. 8.

The method may further include removing the third pair of shoelaces from the second pair of shoelaces. Removing the third pair of shoelaces from the second pair of shoelaces may include uncoupling the magnetic end of the fifth shoelace from the magnetic end of the fourth shoelace and uncoupling the magnetic end of the magnetic end of the sixth shoelace from the magnetic end of the third shoelace. The magnetic ends may be uncoupled without untying the bow. The method may further include immediately coupling the magnetic end of the third shoelace to the magnetic end of the fourth shoelace, such that an observer does not see the magnetic ends of the second pair of shoelaces uncoupled. An observer may be surprised that the bow can be easily removed from the second pair of shoelaces.

The method may further include connecting the third pair of shoelaces to the first pair of shoelaces. Connecting the third pair of shoelaces to the first pair of shoelaces may include coupling the magnetic end of the fifth shoelace to the magnetic end of the second shoelace and coupling the magnetic end of the sixth shoelace to the magnetic end of the first shoelace, as illustrated, for example, in FIG. 9. The third pair of shoelaces may appear to have magically attached to the first pair of shoelaces, without the observer having seen the magnetic ends of the first pair of shoelaces quickly uncouple from each other and then couple to the magnetic ends of the third pair of shoelaces.

The method may further include removing the third pair of shoelaces from the first pair of shoelaces by uncoupling the magnetic end of the fifth shoelace from the magnetic end of the second shoelace and uncoupling the magnetic end of the sixth shoelace from the magnetic end of the first shoelace. The magnetic ends of the first pair of shoelaces may immediately recouple to each other, such that an observer does not notice the first pair of shoelaces has magnetic ends. The third pair of shoelaces may then be connected to the second pair of shoelaces by coupling the magnetic end of the fifth shoelace to the magnetic end of the fourth shoelace and coupling the magnetic end of the sixth shoelace to the magnetic end of the third shoelace, as illustrated, for example, in FIG. 8.

The method may further include inserting a ring between the magnetic ends of the first pair of shoelaces. The ring may be slid between the magnetic end of the first shoelace and the magnetic end of the second shoelace. The magnetic end of the first shoelace and the magnetic end of the second shoelace may immediately recouple after the ring is slid between them, as illustrated, for example, in FIG. 12. Inserting the ring between the first pair of shoelaces may appear to defy the laws of physics to an observer, as the ring slides through and on to what appears to be a single, continuous shoelace.

The method may further include removing the third pair of shoelaces from the second pair of shoelaces by uncoupling the magnetic end of the sixth shoelace from the magnetic end of the third shoelace and uncoupling the magnetic end of the fifth shoelace from the magnetic end of the fourth shoelace. The magnetic ends of the second pair of shoelaces may immediately recouple to each other. The third pair of shoelaces may then be connected to the first pair of shoelaces by coupling the magnetic end of the sixth shoelace to the magnetic end of the first shoelace and coupling the magnetic end of the fifth shoelace to the magnetic end of the second shoelace. The third pair of shoelaces may remain tied in a bow, as illustrated, for example, in FIG. 13.

The method may further include untying the bow of the third pair of shoelaces, as illustrated, for example, in FIG. 14. The magnetic end of the sixth shoelace may remain coupled to the magnetic end of the first shoelace and the magnetic end of the fifth shoelace may remain coupled to the magnetic end of the second shoelace when the bow of the third pair of shoelaces is untied, as illustrated in FIG. 14. The ring may then be slid off either the coupled second and fifth shoelace or the coupled first and sixth shoelace. An observer may be surprised that the bow is capable of being untied and the ring is capable of being slid off. The observer may be surprised that the coupled first pair and third pair of shoelaces appear to be one single, continuous shoelace because the third pair of shoelaces was previously connected to the second pair of shoelaces.

In some embodiments, the aglet ends of the first shoelace, second shoelace, third shoelace, fourth shoelace, and seventh shoelace may be hidden within the shoe, such that the shoelaces appear to be one continuous shoelace having only two aglet ends visible. The aglet end of the fifth shoelace and the aglet end of the sixth shoelace may be the only two aglet ends visible to an observer.

In another embodiment, the method may include lacing two shoes with components described herein. The method may be performed on two shoes simultaneously. The steps of the method may be rearranged in any order as a magician desires to perform different kinds of magic tricks.

Figure 17:
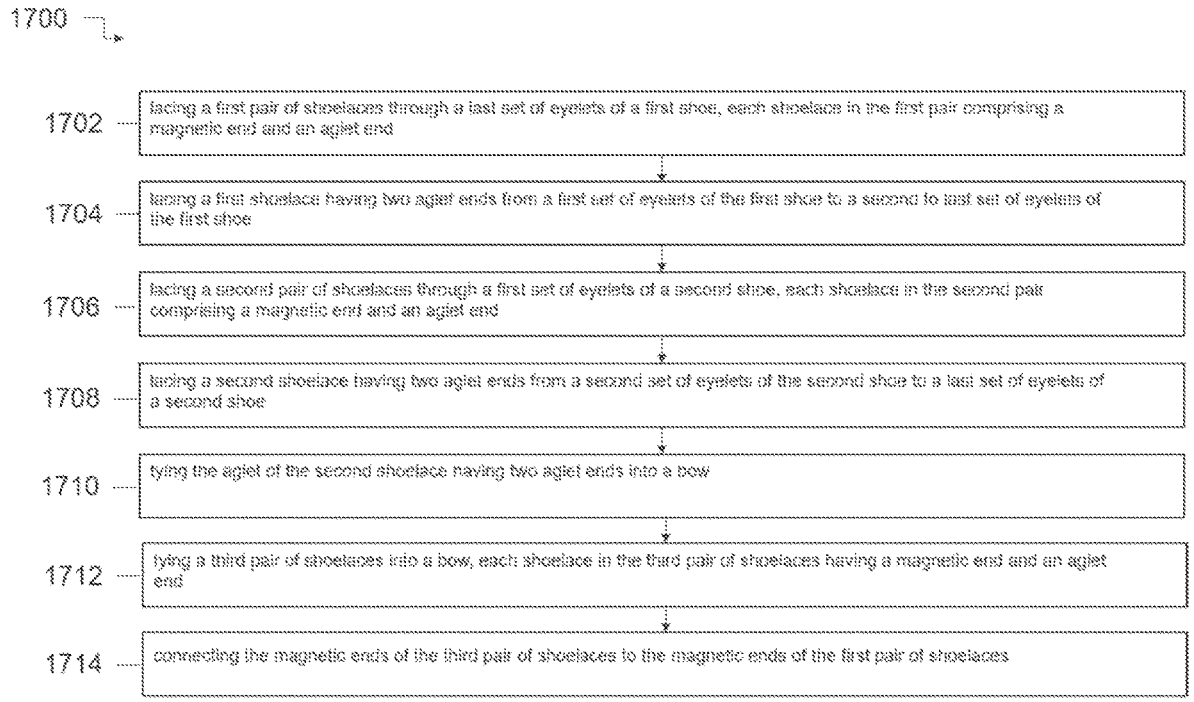
FIG. 17 is a flowchart for a method of performing a magic trick in one example.

Further provided herein is a method of performing a magic trick with a magic kit comprising a first shoelace, a second shoelace, a third shoelace, a fourth shoelace, a fifth shoelace, a sixth shoelace, a seventh shoelace, and an eighth shoelace. As illustrated in FIG. 17, the method 1700 may include multiple steps.

At a first step 1702, the method may include lacing a first pair of shoelaces through a last set of eyelets of a first shoe. The first pair of shoelaces may include the first shoelace having a magnetic end and an aglet end and the second shoelace having a magnetic end and an aglet end. The last set of eyelets may be the set of eyelets closest to the topline of the first shoe (e.g., where a foot is inserted in the shoe). The magnetic end of the first shoelace may be removably coupled to the magnetic end of the second shoelace.

At a second step 1704, the method may include lacing a single shoelace having two aglet ends from a first set of eyelets (e.g., the eyelets closest to the toe of the shoe) to a second to last set of eyelets (e.g., the eyelets adjacent to the last set of eyelets). The single shoelace may be the seventh shoelace having two aglet ends.

At a third step 1706, the method may include lacing a second pair of shoelaces through a first set of eyelets (e.g., the eyelets closest to the toe of the shoe). The second pair of shoelaces may include the third shoelace having a magnetic end and an aglet end and the fourth shoelace having a magnetic end and an aglet end. The magnetic end of the third shoelace may be removably coupled to the fourth shoelace.

At a fourth step 1708, the method may include lacing another single shoelace having two aglet ends from the second set of eyelets (e.g., the eyelets adjacent to the first set of eyelets) to the last set of eyelets of the shoe. The last set of eyelets may be the set of eyelets closest to the topline (e.g., where a foot is inserted into the shoe). In an example, the other single shoelace may be the eighth shoelace having two aglet ends.

At a fifth step 1710, the method may include tying the aglet ends of the other shoelace (eighth shoelace) into a bow. The second shoe may appear to be a normal shoe having one continuous shoelace.

At a sixth step 1712, the method may include tying a third pair of shoelaces into a bow. The third pair of shoelaces may include the fifth shoelace having a magnetic end and an aglet end and the sixth shoelace having a magnetic end and an aglet end.

At a seventh step 1714, the method may include connecting the magnetic ends of the third shoelace to the magnetic ends first pair of shoelaces. Connecting the magnetic ends of the third pair of shoelaces to the first pair of shoelaces may include removably coupling the magnetic end of the fifth shoelace to the magnetic end of the second shoelace and removably coupling the magnetic end of the sixth shoelace to the magnetic end of the first shoelace. The first shoe may appear to an observer to be a normal shoe laced with a single, continuous shoelace.

The method may further include removing the third pair of shoelaces from the first pair of shoelaces. Removing the third pair of shoelaces from the first pair of shoelaces may comprising uncoupling the magnetic end of the sixth shoelace from the magnetic end of the first shoelace and uncoupling the magnetic end of the fifth shoelace from the magnetic end of the second shoelace. The magnetic ends of the first pair of shoelaces may immediately recouple to each other, such that the first pair of shoelaces appears to be one continuous shoelace. The bow of the third pair of shoelaces may remain in a bow when the third pair of shoelaces is removed from the first pair of shoelaces.

The method may further include connecting the magnetic ends of the third pair of shoelaces to the magnetic ends of the second pair of shoelaces. Connecting the magnetic ends of the third pair of shoelaces to the magnetic ends of the second pair of shoelaces may include coupling the magnetic end of the fifth pair of shoelaces to the magnetic end of the fourth pair of shoelaces and coupling the magnetic end of the sixth pair of shoelaces to the magnetic ends of the third pair of shoelaces. The third pair of shoelaces may remain in a bow when connected to the second pair of shoelaces. The second shoe may appear to have two bows to an observer.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. A magic kit for a removable bow comprising:

a first pair of shoelaces, wherein each shoelace comprises a magnetic end and an aglet end;

a second pair of shoelaces, wherein each shoelace comprises a magnetic end and an aglet end;

a third pair of shoelaces, wherein each shoelace comprises a magnetic end and an aglet end; and a shoelace comprising two aglet ends, wherein the magnetic ends of the third pair of shoelaces are configured to connect to the magnetic ends of the first pair and/or the second pair of shoelaces, wherein the first pair, the second pair, the third pair, and the shoelace comprising two aglet ends appear to be a single, continuous shoelace when laced to a shoe, wherein the first pair of shoelaces has a length of 210 mm to 300 mm when the magnetic ends of each shoelace in the first pair of shoelaces are connected, and wherein the second pair of shoelaces has a length of 210 mm to 300 mm when the magnetic ends of each shoelace in the second pair of shoelaces are connected.

2. The magic kit of claim 1, wherein the magnetic ends of each shoelace in each pair are configured to connect to each other.

3. The magic kit of claim 1, wherein the first and second pairs of shoelaces have the same length.

4. The magic kit of claim 1, further comprising a second shoelace comprising two aglet ends.

5. The magic kit of claim 4, wherein the shoelaces having two aglet ends have a length of about 800 mm to about 1200 mm.

6. The magic kit of claim 1, further comprising a ring operable to slide along any of the shoelaces, wherein the ring is separate from any of the shoelaces.

7. The magic kit of claim 1, wherein the third pair of shoelaces has a length of about 400 mm to about 600 mm when connected.

8. The magic kit of claim 1, further comprising a packaging configured to hold the three pairs of shoelaces and the shoelace having two aglet ends.

9. The magic kit of claim 1, further comprising a second shoe.

10. The magic kit of claim 1, wherein the magnetic ends of the first pair, the second pair, and the third pair are configured to easily uncouple when provided a force.

11. The magic kit of claim 10, wherein the magnetic ends of the first pair, the second pair, and the third pair are configured to couple when the force is removed.

12. The magic kit of claim 1, further comprising instructions for use, the instructions for use comprising:

lacing the first pair of shoelaces through a first set of eyelets of the shoe;

lacing the second pair of shoelaces through a last set of eyelets of the shoe;

lacing the single shoelace with two aglet ends from a second set of eyelets of the shoe to a second to last set of eyelets of the shoe;

tying the third pair of shoelaces into a bow; and connecting the magnetic ends of the third pair of shoelaces to the magnetic ends of the second pair of shoelaces.

13. The magic kit of claim 12, the instructions for use further comprising:

removing the third pair of shoelaces from the second pair of shoelaces; and connecting the magnetic ends of the third pair of shoelaces to the magnetic ends of the first pair of shoelaces.

14. The magic kit of claim 13, the instructions for use further comprising:

removing the third pair of shoelaces from the first pair of shoelaces; and connecting the magnetic ends of the third pair of shoelaces to the magnetic ends of the second pair of shoelaces.

15. The magic kit of claim 14, the instructions for use further comprising:

inserting a ring between the magnetic ends of the first pair of shoelaces;

removing the third pair of shoelaces from the second pair of shoelaces; and connecting the magnetic ends of the third pair of shoelaces to the magnetic ends of the first pair of shoelaces.

16. The magic kit of claim 15, the instructions for use further comprising:

untying the bow of the third pair of shoelaces; and sliding the ring off one of the aglet ends of the third pair of shoelaces.

17. A magic kit for a removable bow comprising:

a first pair of shoelaces, wherein each shoelace consists essentially of a magnetic end, an aglet end, and a shoelace portion between the magnetic end and the aglet end;

a second pair of shoelaces, wherein each shoelace consists essentially of a magnetic end, an aglet end, and a shoelace portion between the magnetic end and the aglet end;

a third pair of shoelaces, wherein each shoelace consists essentially of a magnetic end, an aglet end, and a shoelace portion between the magnetic end and the aglet end; and a shoelace consisting essentially of two aglet ends and a shoelace portion between the two aglet ends.

18. The magic kit of claim 17, wherein the first pair of shoelaces, the second pair of shoelaces, the third pair of shoelaces, and the shoelace consisting essentially of two aglet ends and a shoelace portion between the two aglet ends appear to be a single, continuous shoelace when laced to a shoe.

* * * * *